US006873790B1

(12) United States Patent
Cooper et al.

(10) Patent No.: US 6,873,790 B1
(45) Date of Patent: Mar. 29, 2005

(54) LAMINAR AIR FLOW, LOW TEMPERATURE AIR HEATERS USING THICK OR THIN FILM RESISTORS

(76) Inventors: Richard Cooper, 60274 Woodside Rd., Bend, OR (US) 97702; Thomas Fich-Pedersen, Ved Kloevermarken 8, 3. tv., Copenhagen S (DK), DK-2300

( * ) Notice: Subject to any disclaimer, the term of this patent is extended or adjusted under 35 U.S.C. 154(b) by 0 days.

(21) Appl. No.: 10/689,813

(22) Filed: Oct. 20, 2003

(51) Int. Cl.[7] ..... F24H 3/00

(52) U.S. Cl. ..... 392/379; 392/360; 392/486; 392/488; 219/543

(58) Field of Search ..... 392/360, 379, 392/363–369, 486, 488, 438, 439, 490, 493; 219/543, 536–537

(56) References Cited

U.S. PATENT DOCUMENTS

| | | | | | |
|---|---|---|---|---|---|
| 1,258,904 | A | * | 3/1918 | Hughes | 219/536 |
| 1,376,971 | A | * | 5/1921 | Qualman | 219/201 |
| 1,490,088 | A | * | 4/1924 | Bridges | 219/534 |
| 1,491,194 | A | * | 4/1924 | Burger | 392/350 |
| 1,982,190 | A | * | 11/1934 | Ball et al. | 392/365 |
| 2,119,680 | A | * | 6/1938 | Long | 219/537 |
| 3,215,828 | A | * | 11/1965 | Bonvallet et al. | 362/218 |
| 3,995,143 | A | * | 11/1976 | Hervert | 219/553 |
| 4,056,823 | A | * | 11/1977 | Thornburg | 346/76.1 |
| 4,315,128 | A | * | 2/1982 | Matcovich et al. | 219/85.16 |
| 4,757,183 | A | * | 7/1988 | Karey et al. | 392/341 |
| 6,376,816 | B2 | * | 4/2002 | Cooper et al. | 219/543 |
| 2001/0003336 | A1 | * | 6/2001 | Abbott et al. | 219/543 |
| 2003/0116559 | A1 | * | 6/2003 | Park | 219/543 |

FOREIGN PATENT DOCUMENTS

| | | | | |
|---|---|---|---|---|
| JP | 11-196927 | * | 7/1999 | |
| SU | 1560942 | * | 4/1990 | 392/365 |

* cited by examiner

*Primary Examiner*—John A. Jeffery
(74) *Attorney, Agent, or Firm*—Glenn C. Brown

(57) ABSTRACT

An elongate heating element that includes an insulative substrate and a resistive coating that heats to a predetermined temperature when an electrical current is passed through the coating. The insulative material forming the substrate is preferably a ceramic such as cordierite, but the invention is not limited to any particular insulative material. An air moving device directs an air stream over the resistive coating in order to heat the air stream.

1 Claim, 6 Drawing Sheets

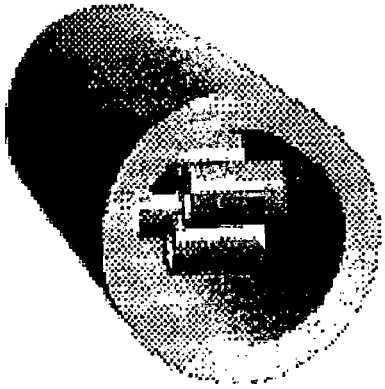
Fig. 3A
Fig. 3B
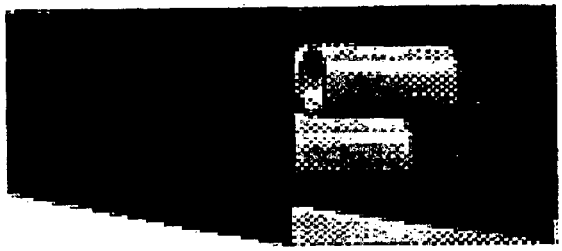
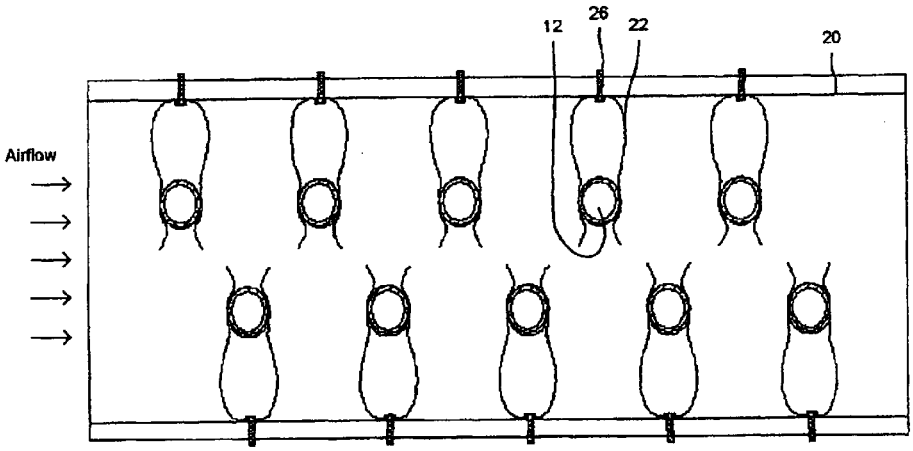
Fig. 3C

Fig. 4
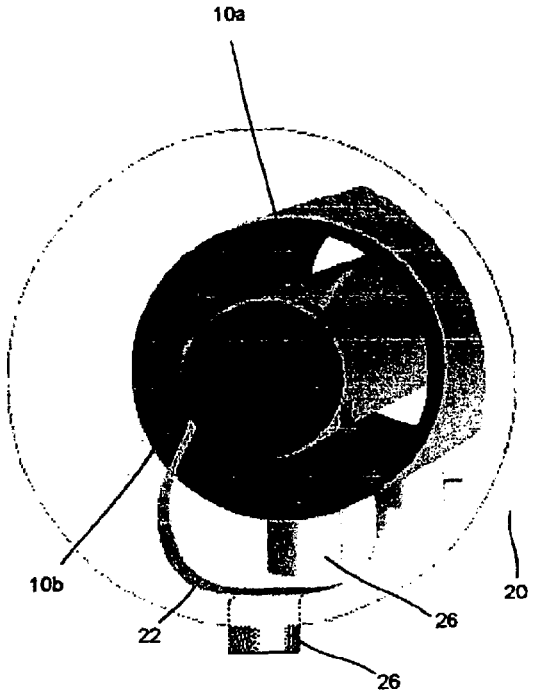
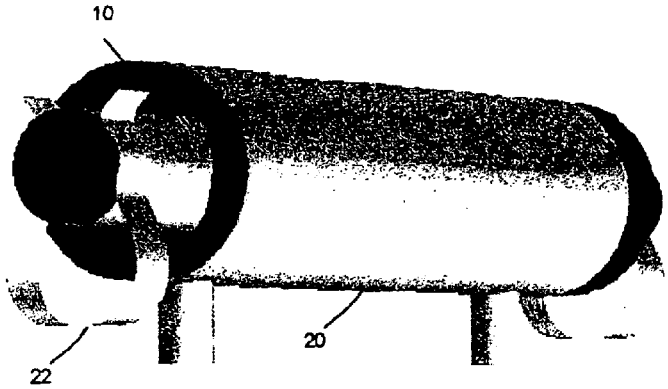
Fig. 5A
Fig. 5B
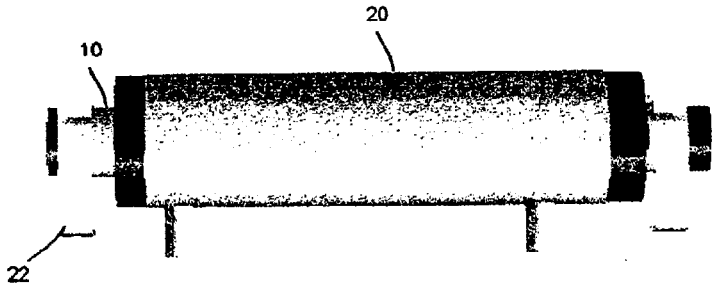

LAMINAR AIR FLOW, LOW TEMPERATURE AIR HEATERS USING THICK OR THIN FILM RESISTORS

BACKGROUND OF THE INVENTION

This invention is related to heaters, and in particular to heaters used to heat streams of air. Air heaters are used to create hot airflows in appliances such as dryers, room heaters, and other heating devices. Most air heaters heat airstreams by directing a flow of air over coiled resistive wires that are electrically heated to a relatively high temperature; in many cases the heated coils are red hot. This configuration provides a very high temperature difference between the wire and the air, and provides the desired rate of heat transfer into the air stream despite the relatively small surface area of the wire. In dryers the high temperatures of the heating elements can cause fire hazards, and in general it leads to relatively large inefficiencies. As energy costs continue to rise, the efficiency losses in air heaters represent a greater and greater disadvantage. A need remains for an improved technology for heating air in a variety of heating devices for home and industrial use.

SUMMARY OF THE INVENTION

This invention serves to eliminate some of the inefficiencies inherent in current designs by providing air heaters that can be configured in many different designs and sizes, and in which the temperature of the heated surface is relatively low compared to known heating devices. The lower temperature heating surface is relatively large to provide the necessary heat transfer to the air. The heating surface is formed of a resistive thick or thin film deposited over a relatively large area compared to the wire in the traditional heaters, but which can at the same time be packaged in a relatively small enclosure. The heating elements of the present invention can be formed as tubes, plates, and in other configurations as described in greater detail below.

BRIEF DESCRIPTION OF THE DRAWINGS

FIG. 3A is an end view of another preferred embodiment of the invention that includes multiple transverse heating tubes of the type depicted in FIG. 1.

FIG. 3B is an end view of another preferred embodiment of the invention that includes multiple transverse heating tubes of the type depicted in FIG. 1.

FIG. 3C is a cross-sectional view of a heater depicted in FIG. 3B.

FIG. 4 is a perspective end view of another preferred embodiment of the invention that utilizes concentric tubular heating elements.

FIG. 5A is a perspective end quarter view of another preferred embodiment of the invention that utilizes a tubular heating element and in which the ends of the tubular heating element protrude from the housing.

FIG. 5B is a side elevational view of the embodiment shown in FIG. 5A.

DETAILED DESCRIPTION OF THE INVENTION

Figure 1:
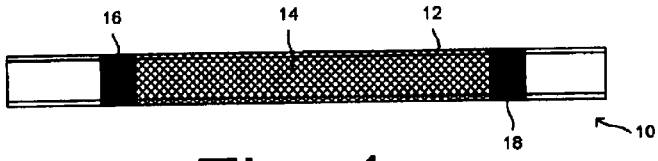
FIG. 1 is a schematic depiction of a preferred embodiment of the invention.

Referring now to FIG. 1, the present invention in its most general form is embodied in an elongate heating element that includes an insulative substrate and a resistive coating that heats to a predetermined temperature when an electrical current is passed through the coating. The insulative material forming the substrate is preferably a ceramic such as cordierite, but the invention is not limited to any particular insulative material. One preferred embodiment in the form of a heating tube is illustrated in FIG. 1 at 10. This embodiment includes a tube 12 with a resistive layer 14 formed on the outer surface of the tube 12.

Resistive heating layer 14 is preferably a thick resistive film such as a graphite based sol gel manufactured by Datec Corporation of Milton, Ontario, Canada. The sol gel is preferably screen printed or sprayed onto tube 12 as a liquid, and cured at 350° C. or above. It is then stable in air up to a temperature of over 350° C. In other embodiments the resistive film could also be a thin film such as $SnO_2$:F deposited by an evaporation process like PVD or CVD.

Electrical terminals 16 and 18 are formed at each end of the resistive layer 14. Electrical terminals 16 and 18 are preferably formed of silver and are positioned along the left and right edges of the resistive film before curing, and are bonded to the sol gel during curing. Electrical terminals 16 and 18 are formed by applying a curable silver-containing emulsion such as DuPont No. 7713. The buses could also be formed of other conductive metals such as aluminum or copper applied in ways familiar to those of skill in the art.

When a voltage is applied to the terminals 16 and 18 the resulting electrical current heats the resistive layer 14 and tube 12.

Figure 2A:
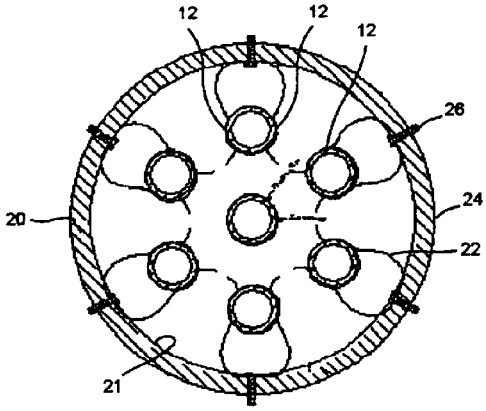
FIG. 2A is an end view of a second preferred embodiment of the invention that includes multiple heating tubes of the type depicted in FIG. 1.
Figure 2B:
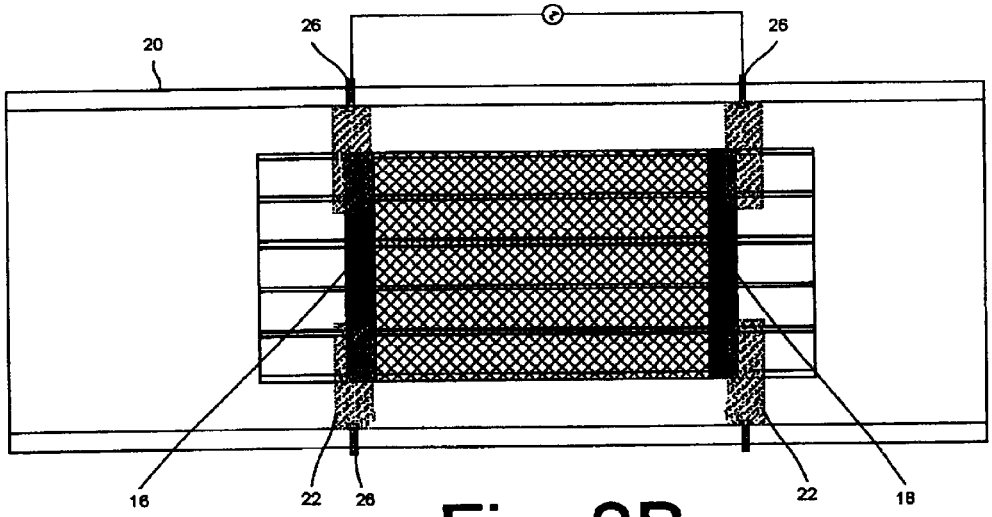
FIG. 2B is a cross-sectional view of a heater depicted in FIG. 2B.

Turning to FIG. 2, in preferred embodiments a number of tubes 12 are placed inside a housing 20 through which the air is caused to flow. In this manner the heat is transferred by convection to the bypassing air. The heater tubes 12 can be placed either with their axis parallel to the flow direction, as illustrated in FIGS. 2A and 2B, or with the tube axis perpendicular to the air flow as shown in FIGS. 3A–3C. Referring to FIGS. 2A and 3C, tubes 12 are mounted in housing 20 by in terminal clamps 22 with each tube 12 being engaged with two clamps 22, one each on terminal 16 or 18 of each tube 12. Each terminal clamp 22 is mounted to the inner surface 21 of housing 20 by a connector 26 which extends through the housing 20. Connectors 26 are connected to an external electrical source 28 to provide an operating current for the heater. In the embodiments shown in FIGS. 3A–3C, the tubes 12 are mounted in a similar manner in a transverse orientation to the air flow through housing 20.

In another embodiment as shown in FIG. 4A, two concentric tubular heating elements 10*a* and 10*b* are mounted in a housing 20 in a manner similar to that described above using clamps 22 and connectors 26. Each tubular heating element includes a resistive layer as described above.

FIGS. 5A and 5B illustrate another embodiment in which terminals 16 and 18 of heating element 10 extend beyond the ends of housing 20, and clamps 22 are disposed outside housing 20.

Figure 6A:
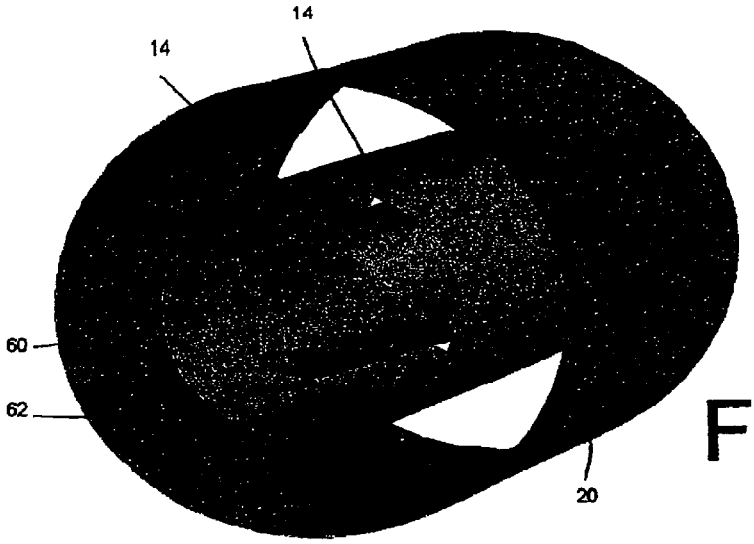
FIG. 6A is a perspective end view of another embodiment of the invention that includes a conical tubular heater and a concentric cylindrical tubular heater.
Figure 6B:
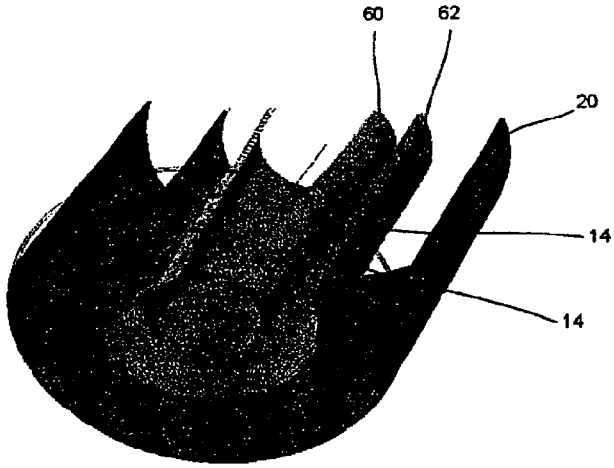
FIGS. 6B and 6C are partial cutaway views of the embodiment shown in FIG. 6A.
Figure 6C:
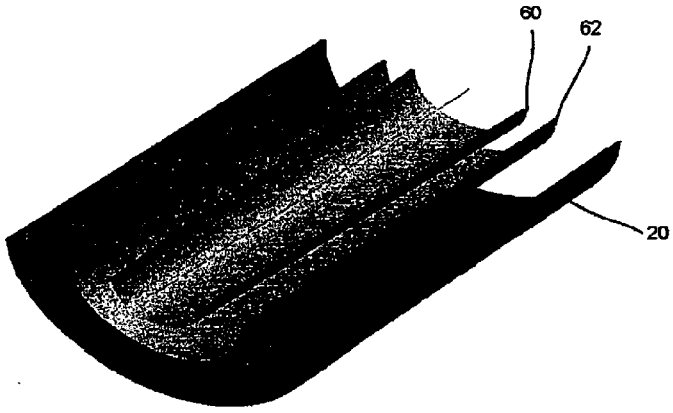

In other preferred embodiments of the invention, one or more of heating elements 10 is conical rather than tubular. FIGS. 6A–6C schematically illustrate one embodiment of the invention that incorporates concentric heating elements, an inner conical element 60 and an outer tubular heating element 62. Both include a resistive layer as described above. Applicants have found that the conical shape of heating element 60 provides enhanced heat transfer from element 60 to the surrounding airflow, and at the same time promotes increased heat transfer from outer tubular heating element 62 to the surrounding airflow. Each heating element is mounted to housing 20 in the manner described in the embodiments described above using clamps (not shown) and electrical connectors (not shown) passing through the housing 20.

Figure 7A:
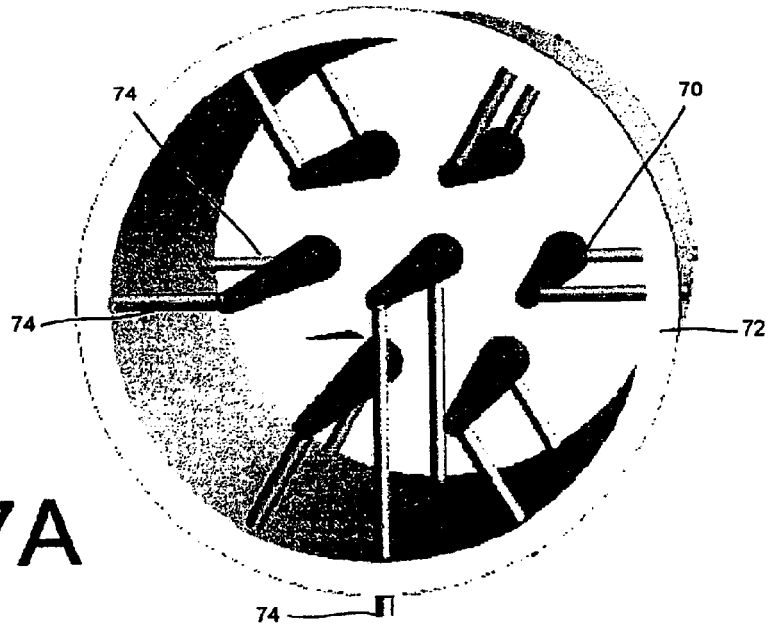
FIGS. 7A, 7B and 7C are perspective end view of another preferred embodiment of the invention that utilizes an array of conical tubular heaters mounted in a housing.
Figure 7B:
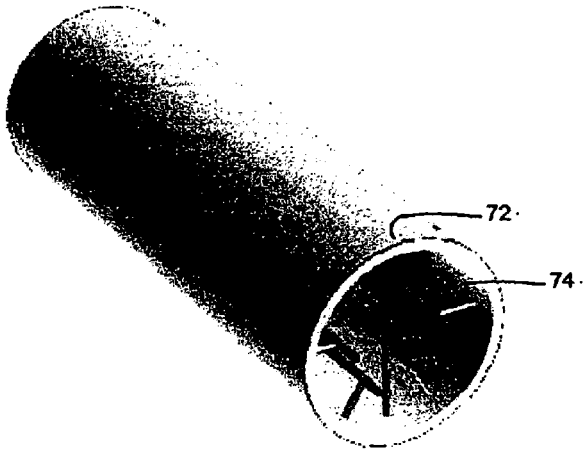
Figure 7C:
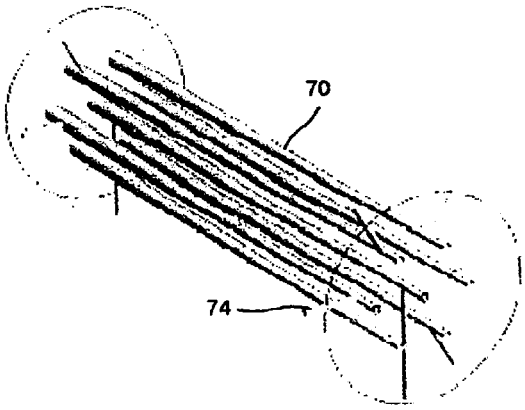

The advantages of a conical heating element configuration can also be exploited by mounting multiple conical heaters within a housing as shown in FIGS. 7A–7C. Each heating element 70 is generally as described above with reference to FIG. 1, and includes an insulative conical member having a resistive layer and terminals formed on its outer surface. Each heating element 70 is mounted in housing 72 by mounting brackets 74, which can include a clamp at its inner end to receive the terminal of the heating element as described above, and which passes through housing 72 and is connected to an electrical source (not shown).

Further to the use of the conical or trapezoidal designs, a cone, which is a trapezoid rolled up, changes the number of squares in the heater which affects the watt density. At the inlet end of the cone or planar substrates the width is narrower resulting in a higher watt density and more energy per square unit. This results in higher heat at the beginning of the structure and lower heat (watt density) at the downstream part of the structure. The film thus does not get overheated, resulting in inefficiency as the air moves down the structure.

The number of squares can be calculated by dividing length by width. Length is direction of current flow (bus to bus). The bus to bus resistance is equal to the sheet resistance times the number of squares. The sheet resistance is calculated by dividing the bus to bus by the number of squares. The power in watts is equal to the voltage squared times the width divided by the resistance (in ohms) per square X length.

Figure 8A:
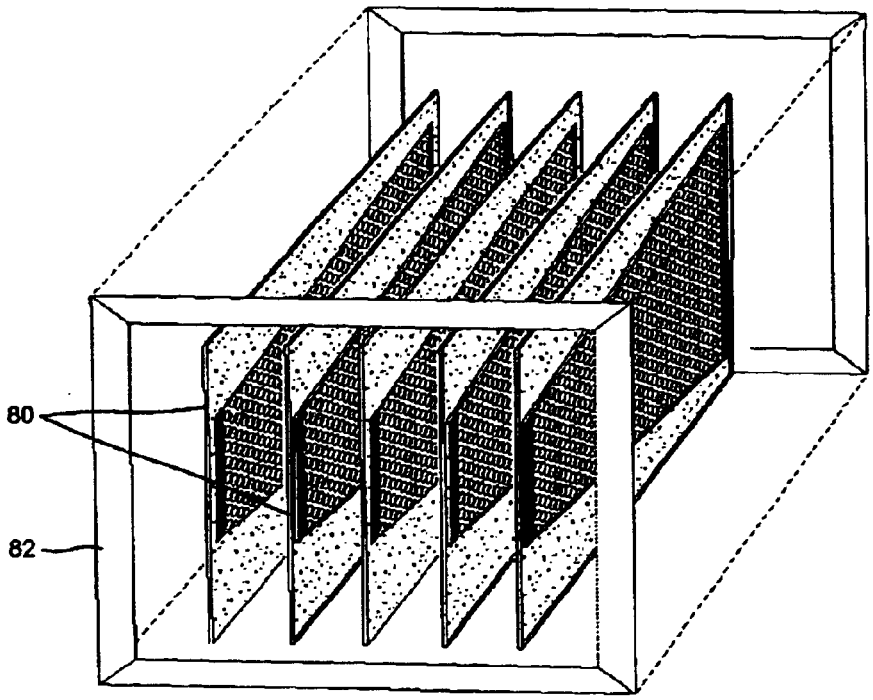
FIG. 8A is an end perspective view of another embodiment of the invention in which planar heating elements are mounted in a housing.
Figure 8B:
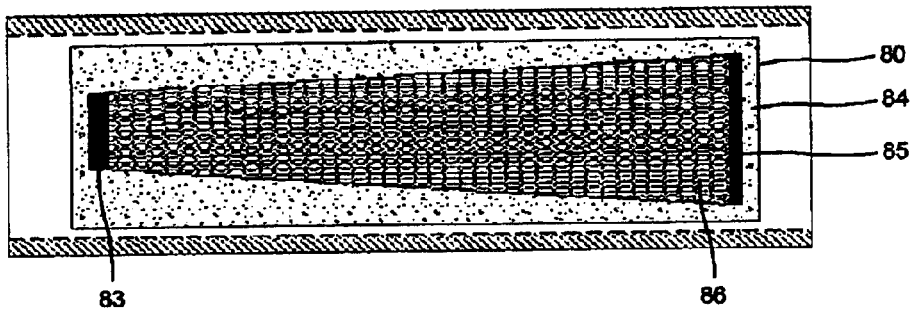
FIG. 8B is a cutaway side view of the heater shown in FIG. 8A and which illustrates in greater detail a planar heater according to the invention.

Referring to FIGS. 8A and 8B, another preferred embodiment of the invention is illustrated. Multiple planar heating elements 80 are mounted in a housing 82. Each heating element includes an insulative substrate 84, preferably formed of a mica material, and a resistive heating layer 86 formed over the insulative substrate 84, on either one or both sides of heating element 80. Terminals 83 and 85 are formed at respective ends of each resistive layer 86 for connection of the heater to an electrical source. Insulative substrate 84 is not limited to mica, but could also be formed of any suitable insulative material. Resistive layer 86 can be formed of any suitable thick or thin film resistive material as described above with reference to FIG. 1. In the embodiment shown, resistive layer 86 is formed in a trapezoidal shape to optimize the heat transfer from heating element 80 to the surrounding airflow, but could also be square or rectangular.

The unexpected advantage demonstrated by a heater according to this invention is a very high thermal efficiency compared to conventional coiled wire heaters. The following examples demonstrate the improved efficiency achieved in tests of heaters according to the invention.

In on example, a heater similar to that shown in FIG. 2A–2B was compared to a conventional resistive wire air heater. The resistive wire air heater consisted of a tubular housing having a diameter of 2½" inches and 8 inches in length, and in which was mounted a coiled resistive wire heating element. Ambient air at 71° F. was introduced at a rate of 60 cfm. Air exited the heater at 138° F., and the heater demonstrated an efficiency of 43%. The efficiency was calculated by dividing the energy transferred to the air stream by the electrical energy provided to the heater which was 870 Watts. A heater according to the present invention, and generally configured as shown in FIG. 2A–B, was then tested. The heater was comprised of 7 tubes with a thick film coating. The tubes were ½" O.D.×⅜" I.D and 4 inches Long. They were mounted in a pipe (duct) 2½" I.D×8 inches long. The heater according to the present invention heated a 60 CFM flow of ambient air from 71° F. to 138° F. utilizing 515 Watts with an efficiency of 60%, an increase of approximately 40% over the resistive wire heater. This increase in efficiency is highly surprising, and represents a significant advance over resistive wire heaters.

While the invention has been described by reference to the embodiments described above, the description of the preferred embodiments is intended to be illustrative and not limiting to the following claims. Those of skill in the art will recognize that numerous changes in detail and arrangement are possible without departing from the scope of the claims.

What is claimed is:

1. A heater comprising:

an insulative substrate, the insulative substrate being at least one hollow tube;

a resistive film on the substrate having first and second spaced apart portions;

first and second connectors in communication with the respective first and second spaced apart portions of the resistive film, and adapted for directing an electrical current from an electrical source through the resistive film; and, an air moving device for directing an air stream over the resistive film, wherein the at least one hollow tube includes at least one hollow, conical tube disposed within a cylindrical hollow tube, each of the conical and cylindrical tubes having the resistive film formed thereon.

* * * * *